US006951353B2

(12) United States Patent
Kozlowski et al.

(10) Patent No.: US 6,951,353 B2
(45) Date of Patent: Oct. 4, 2005

(54) MEDICATION RECORD SYSTEM AND DISPENSER

(76) Inventors: Nancy Kozlowski, 3883 Brocks Mill Rd., Barboursville, VA (US) 22923; Nicholas Webb, 16314 Texas Springs Rd., Redding, CA (US) 96001

( * ) Notice: Subject to any disclaimer, the term of this patent is extended or adjusted under 35 U.S.C. 154(b) by 72 days.

(21) Appl. No.: 10/136,072

(22) Filed: Apr. 30, 2002

(65) Prior Publication Data

US 2002/0171238 A1 Nov. 21, 2002

Related U.S. Application Data

(63) Continuation-in-part of application No. 09/583,125, filed on May 30, 2000, now abandoned.

(60) Provisional application No. 60/292,158, filed on May 18, 2001, and provisional application No. 60/136,796, filed on May 29, 1999.

(51) Int. Cl.[7] ..... G09F 9/00; G09F 9/40; B42D 15/00

(52) U.S. Cl. ..... 283/81; 40/306; 40/310; 40/312; 235/375; 235/380; 235/487; 116/205; 116/212; 116/279; 116/306; 116/121; 206/531; 206/534; 215/365; 283/52.1; 283/101

(58) Field of Search ..... 281/52.1, 81, 101; 235/375, 380, 487; 40/306, 310, 312; 116/121, 205, 212, 279, 306; 206/531, 534; 215/365; 283/81, 52.1, 101

(56) References Cited

U.S. PATENT DOCUMENTS

| | | | | | |
|---|---|---|---|---|---|
| 630,822 | A | * | 8/1899 | Bates | 283/81 |
| 648,063 | A | * | 4/1900 | Bauman | 215/365 |
| 3,054,503 | A | * | 9/1962 | Hartman, Jr. et al. | 206/531 |
| 3,305,077 | A | * | 2/1967 | Greif et al. | 206/232 |
| 3,397,671 | A | * | 8/1968 | Hartman et al. | 206/532 |
| 3,497,059 | A | * | 2/1970 | Watts, Jr. | 206/463 |
| 3,675,620 | A | * | 7/1972 | Baustin | 116/308 |
| 3,757,441 | A | * | 9/1973 | Baustin | 40/638 |
| 3,759,371 | A | * | 9/1973 | Marks | 206/531 |
| 3,780,856 | A | * | 12/1973 | Braverman | 206/534 |
| 3,974,916 | A | * | 8/1976 | Bartolucci | 206/459.1 |
| 4,047,358 | A | | 9/1977 | Heffernan et al. | |
| 4,189,053 | A | * | 2/1980 | Stagnitto et al. | 206/570 |
| 4,254,871 | A | * | 3/1981 | Poore | 206/534 |
| 4,295,567 | A | * | 10/1981 | Knudsen | 206/534 |
| D263,559 | S | * | 3/1982 | Poore | D9/337 |
| D279,865 | S | * | 7/1985 | McKee | D9/347 |
| 4,574,954 | A | * | 3/1986 | Reid | 206/531 |
| 4,700,976 | A | * | 10/1987 | Loose | 283/101 |
| 4,722,451 | A | * | 2/1988 | Conrad | 215/365 |
| 4,736,849 | A | * | 4/1988 | Leonard et al. | 206/534 |
| 4,815,767 | A | * | 3/1989 | Lambert | 283/67 |
| 4,830,407 | A | * | 5/1989 | Sadler et al. | 283/102 |
| 4,889,236 | A | * | 12/1989 | Bartell et al. | 206/531 |

(Continued)

*Primary Examiner*—Derris H. Banks
*Assistant Examiner*—Mark Henderson
(74) *Attorney, Agent, or Firm*—Jagtiani & Guttag

(57) ABSTRACT

The present invention relates to a medication management system that is simple, reliable and extremely easy to use. It comprises a label having a plurality of raised tabs that are depressed upon taking a medication to provide a tactile and a visual record of medication use. It can be secured to the medication container, and thus is not subject to being misplaced or forgotten. The system can be integrated with a pharmacy's computerized pharmaceutical record and prescription label printing system or it can be a stand-alone paste-on label. Alternatively, it can be used in combination with blister packs to dispense medication while maintaining a record of use. The label can be in the form of an overlay, which is placed over a preprinted container or a container having a prescription label. The use of a pressure sensitive releasable adhesive permits the removal of the overlay label in the event that is it necessary to read information on the underlying label. The underlying label is provided with a plurality of raised tabs that correspond to the number of doses to be taken per day and the number of days for which the medication is to be taken.

19 Claims, 15 Drawing Sheets

U.S. PATENT DOCUMENTS 4,895,257 A * 1/1990 Winslow ..... 206/534
4,906,395 A * 3/1990 Stoesser et al. ..... 510/100
4,955,481 A * 9/1990 Novinski et al. ..... 206/534
4,958,736 A * 9/1990 Urheim ..... 206/531
5,011,032 A * 4/1991 Rollman ..... 215/230
5,031,937 A * 7/1991 Nellhaus ..... 283/52.1
5,109,984 A * 5/1992 Romick ..... 206/531
5,261,702 A 11/1993 Mayfield
5,265,728 A * 11/1993 Allendorf et al. ..... 206/534
5,421,286 A * 6/1995 McLean ..... 116/201
5,535,536 A * 7/1996 Comann ..... 40/310
5,613,609 A * 3/1997 Hamilton et al. ..... 206/531
5,694,882 A * 12/1997 Marshall ..... 116/311
5,833,072 A * 11/1998 Lambelet, Jr. ..... 206/534
5,979,698 A * 11/1999 Deal ..... 221/2
6,032,609 A * 3/2000 Luoma ..... 116/306
6,279,759 B1 * 8/2001 Weisbach ..... 211/71.01
6,332,631 B1 * 12/2001 Kirk ..... 283/81
6,375,956 B1 * 4/2002 Hermelin et al. ..... 424/400
6,523,286 B2 * 2/2003 Leicher ..... 40/311
6,523,688 B1 * 2/2003 Palmieri ..... 206/459.1
6,588,180 B2 * 7/2003 Heath et al. ..... 53/440
2001/0044427 A1 * 11/2001 Mazel et al. ..... 514/102

* cited by examiner

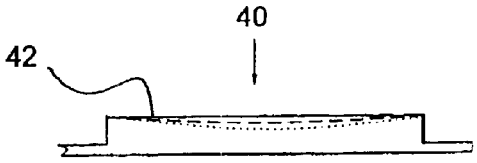
Fig 4
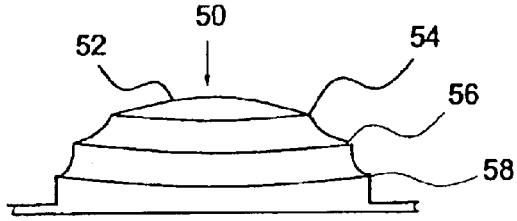
Fig 5
Fig 5a
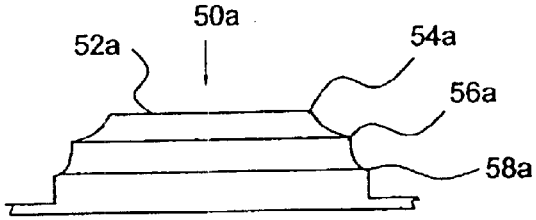
Fig 5b
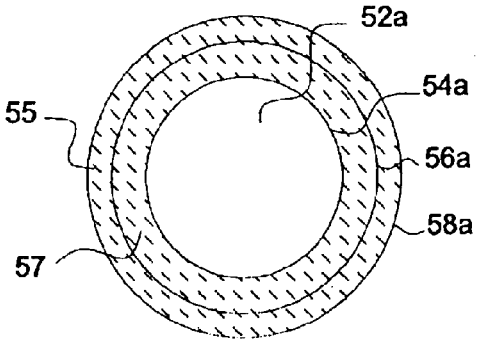

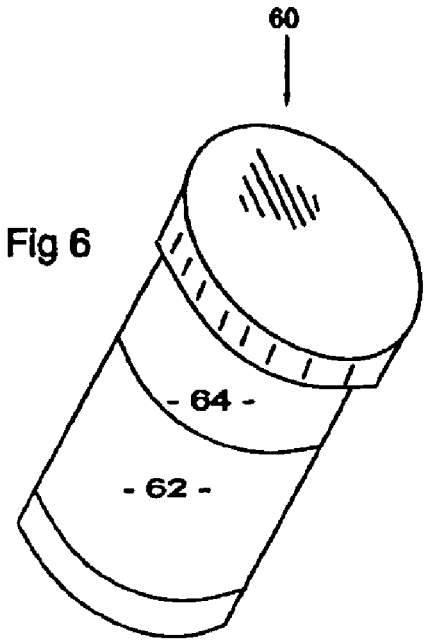
Fig 6
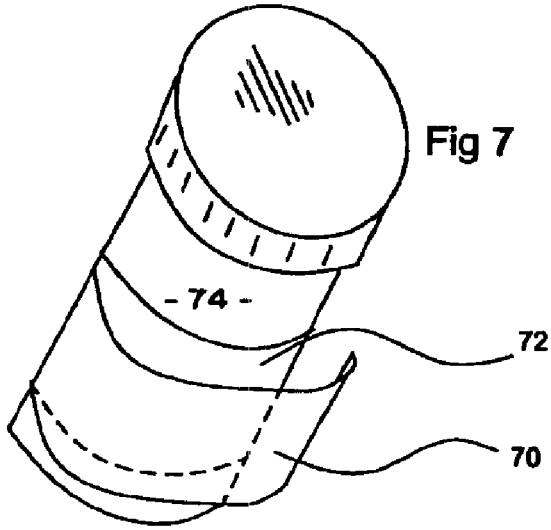
Fig 7
Fig. 7b
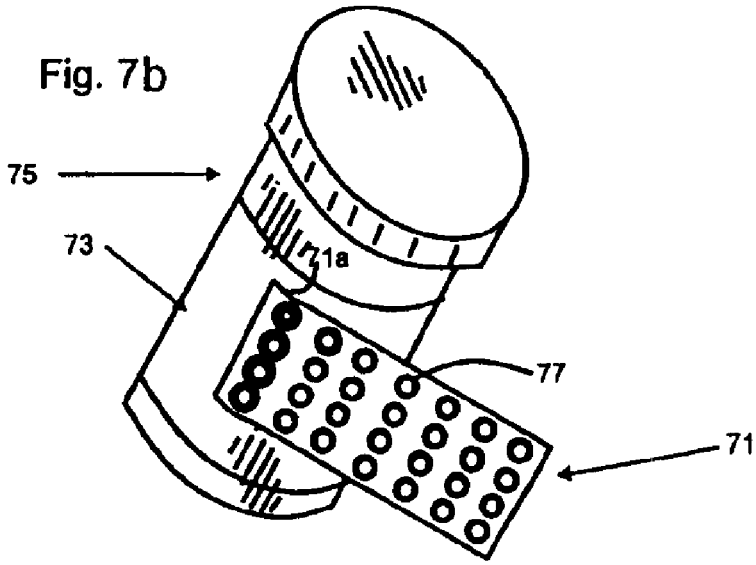

Fig 8
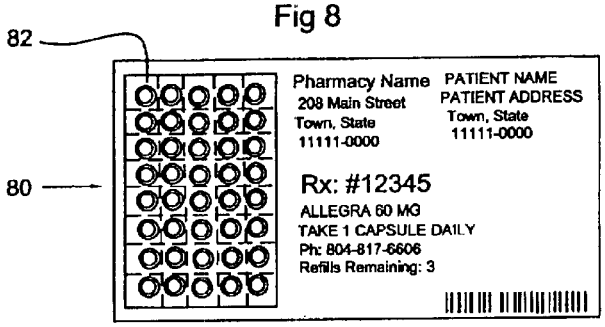
Fig 10
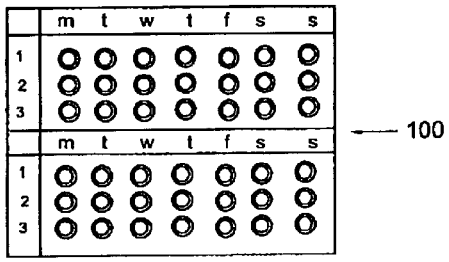
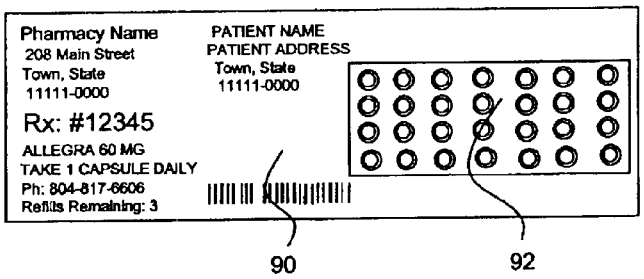
Fig 9

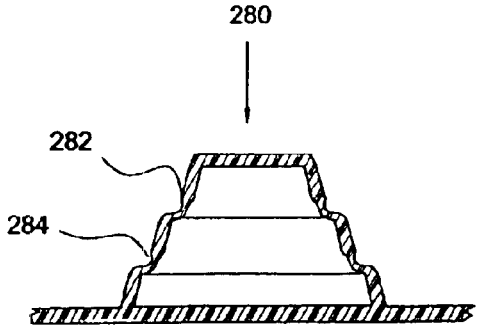
Figure 28a
Figure 29a
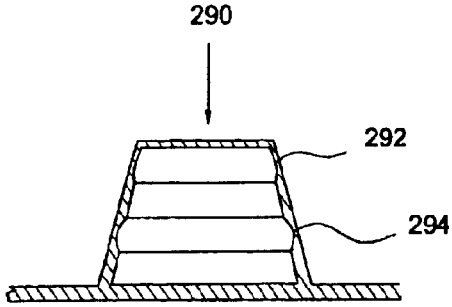
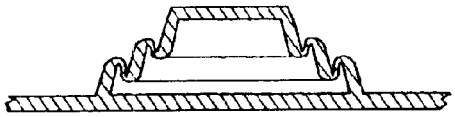
Figure 28b
Figure 29b
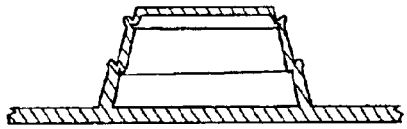
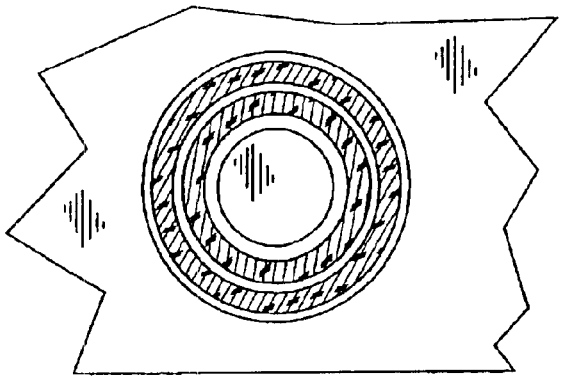
Figure 28c
Figure 29c
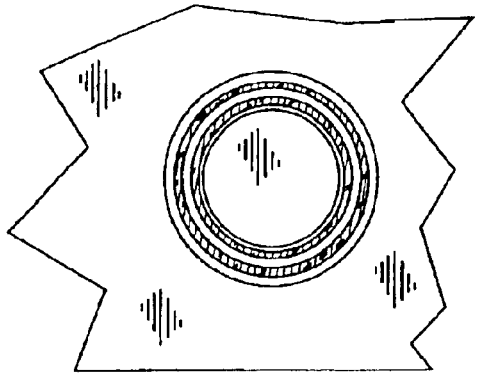

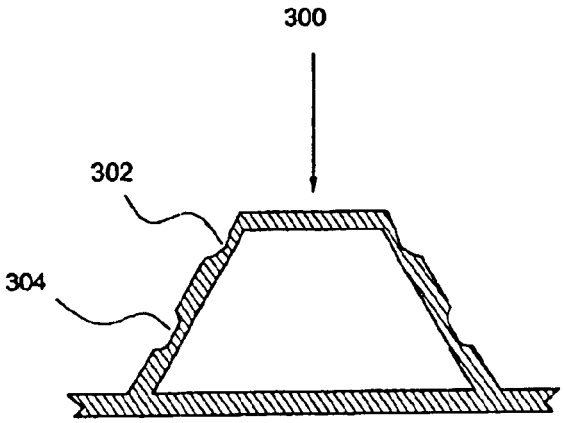
Figure 30a
Figure 30b
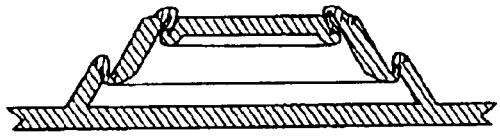
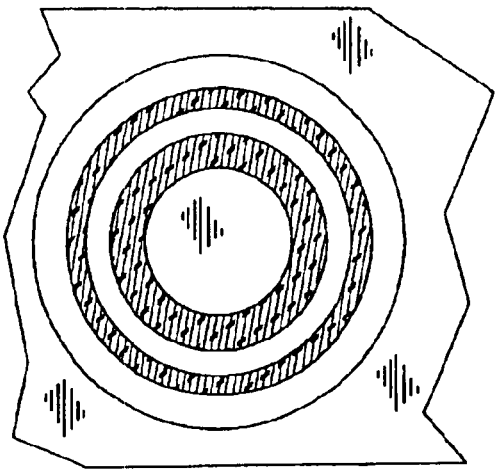
Figure 30c
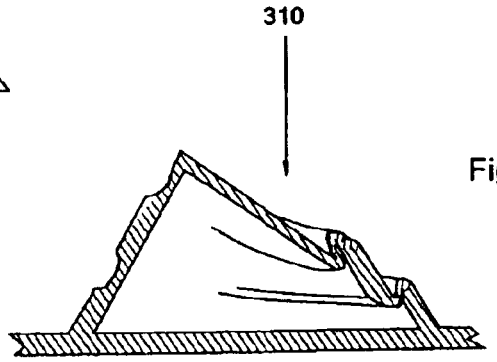
Figure 31

Figure 32
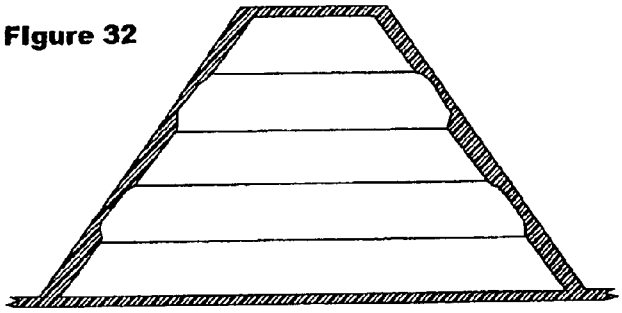
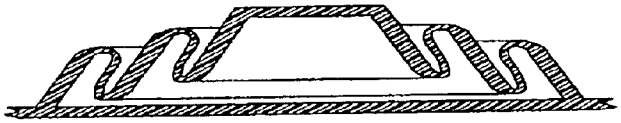
Figure 33
Figure 34
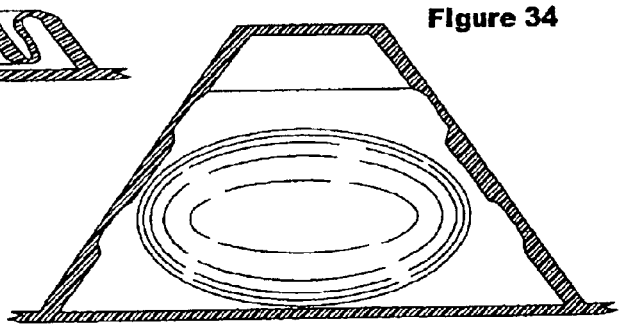
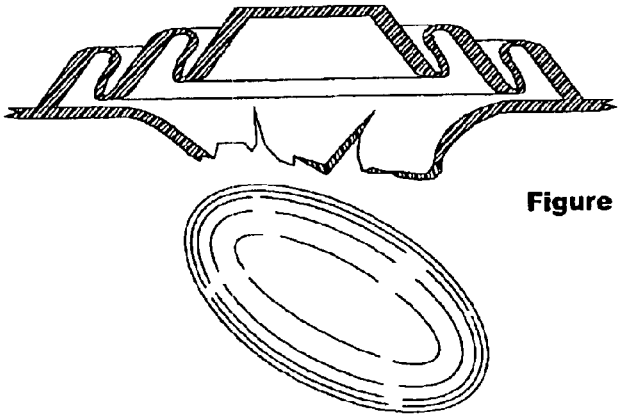
Figure 35

MEDICATION RECORD SYSTEM AND DISPENSER

CROSS REFERENCE TO RELATED APPLICATIONS

The present application claims priority to U.S. provisional application No. 60/292,158 filed May 18, 2001 and is a continuation-in-part of U.S. patent application Ser. No. 09/583,125 filed May 30, 2000, now abandoned which claims priority to U.S. provisional patent application Ser. No. 60/136,796 filed May 29, 1999 which also claims the benefit of 60/292,158 filed May 18, 2001. This application incorporates by reference, as though recited in full, the disclosure of provisional application No. 60/292,158, co-pending patent application No. 09/583,125, and provisional application No. 60/136,796.

BACKGROUND OF THE INVENTION

1. Field of the Invention

This invention relates to an improved system for facilitating the dose record keeping and dispensing of medication, and more particularly to a system for aiding people in the correct administration of medication that is taken over an extended period of time.

2. Brief Description of the Prior Art

It is well recognized that it is essential to assist people in establishing a medication regime, and to enable people to easily keep track of when and if medication has been taken. Numerous patents have proposed electronic reminder systems. One failing of the electronic systems is the high cost of the electronics. Another failing is their inability to note whether medication has been taken. Furthermore, they can be complicated in design and therefore difficult to operate. The emphasis of the electronic system is typically as a reminder mechanism, and thus no record is maintained of whether the medication was actually taken. The problem may be more severe in the case of the elderly and infirmed, but exists even in the case of those who are mentally alert. It is essential that the drug regimen be followed accurately and in a timely manner. Errors and misuse can undermine the effectiveness of medication and can be dangerous to the person using the medication.

The problem is exacerbated when a person is using multiple medications during the same time period. Confusion can readily arise as to which medication was last taken, particularly, in those instances where the regimens differ for two or more of the medications. The need to keep track of a variety of different medication regimens has been well recognized. U.S. Pat. No. 5,261,702 proposes a system that includes a chart. The chart includes such information as the names of the medicines to be taken by a patient and coded symbols are marked on the chart. Times of the day are marked, printed, or otherwise placed on the chart. The coded symbols have distinctive varying shapes, such as circles, squares, triangles and the like. Additionally, various colors can be used to assist in the distinguishing between various medications.

The '702 patent also suggests the use of a laminated sheet, as for example a film plastic, so the marks can be easily erased. In one embodiment, a clear plastic surface is used so the sheet underlying the clear plastic surface would be visible and the coded symbols, horizontal rows, and vertical columns are visible. The chart is suggested as possibly being a ferrous material or a magnetic material so that the magnetic marking elements may be attached to the chart surface.

In another embodiment, an adhesive can be provided so that the chart can be mounted on any surface.

U.S. Pat. No. 4,815,767 is illustrative of another chart system for use in assisting a patient in tracking a medication regimen.

A novel system for tracking medication use has been previously described by Kozlowski in U.S. patent application Ser. No. 09/583,125. This application is incorporated by reference herein as though recited in its entirety. This system uses an overlay which can be added to the prescription label or printed separately. The overlay contains check boxes for the user to fill in with a mark to designate taking a pill over a set time period.

Blister style packaging is also well known in the art and blister style packaging for medications is likewise well known in the art. The method and apparatus for forming blister style display packages has been disclosed in a variety of patents and other publications. It is known to seal articles in pockets that are formed and sealed in plastic windows of paperboard blanks. These blanks have one or more openings that are covered, on one surface, by a heat-deformable and heat-sealable plastic sheet. The pockets are formed by heating the plastic material extending across the windows and deforming this plastic material to form a blister. After the article is placed in the blister, the blister is closed, for example by folding the blank about a fold line and then heat-sealing the plastic material. As the plastic sheet or film which is used is generally transparent, the article is provided in a decorative package in which it is sealed but nevertheless is fully visible. The teachings are best described in U.S. Pat. No. 4,047,358 to Heffernan et al among others.

SUMMARY OF THE INVENTION

The present invention relates to a medication management system that is simple, reliable and extremely easy to use. It comprises a card or overlay with raised tabs that are pressed down after a pill is taken. The plastic tab changes appearance from clear to opaque and changes shape from a rounded blister to a flattened dimple providing both a visual and a tactile indication. The term tab, as employed herein, includes pillbox, blister and similar shapes. The blister can have a flat or rounded top or other top contour. The device can be secured to the medication container thus reduce the likelihood of it inadvertently being misplaced or forgotten. The device can be integrated with a pharmacy's computerized pharmaceutical record and prescription label printing system or it can be a stand-alone paste on device. The device is preferably in the form of an overlay, which is placed over a preprinted container. The use of a pressure sensitive releasable adhesive permits the removal of the overlay label in the event that is it necessary to read information on the underlying label. Alternatively the device can be manufactured in clear plastic to permit reading of the prescription information through the device. The need to read the underlying label can be critical in the event of a person taking an overdose of a medication or a child inadvertently ingesting the medication. Additionally, being able to read the underlying label can be important when the patient desires to refill the prescription. Finally, the device can be incorporated into traditional blister style pill cards wherein the card contains the dosages incorporated within the blister and the card incorporates the dimpled blister design to provide both the clear to opaque color change and the rounded to inverted tactile change. This enables the user to determine if a dosage has been taken, by both tactile and visual cues, providing an advantage for aged and infirmed patients.

BRIEF DESCRIPTION OF THE DRAWINGS

The accompanying drawings illustrate several embodiments of the present invention and together with the description of the invention, provide a full disclosure of the invention. The drawings are only for the purpose of illustrating representative and preferred embodiments of the invention, and should not be read as limiting the invention to the specific embodiments illustrated.

FIG. 4 is a close up side view of a depressed blister of the device.

FIG. 5 is a close up side view of a second embodiment of an intact dimpled blister of the device.

FIG. 5*a* is a close up side view of a second embodiment of an intact dimpled blister of the device wherein the blister has a flat top surface.

FIG. 5*b* is a top view of the dimpled blister of FIG. 5*a*.

FIG. 6 is a perspective view of a medicine container having a medication management label of the present invention, affixed thereto.

FIG. 7 is a perspective view of the medicine container of FIG. 6 with the medication management label in partially peeled off status.

FIG. 7*b* is a perspective view of a medicine container having a medication management label affixed at one end of the label.

FIG. 8 is a plan view of a prescription label in combination with a medication management label.

FIG. 9 is a plan view of a medication management label overlay.

FIG. 10 is a plan view of an alternate embodiment of a medication management label in combination with a prescription label.

FIG. 28*a* is a side view of an intact raised tab with one embodiment of an injection molded design.

FIG. 28*b* is a side view of the dimpled blister of FIG. 28*a* wherein the blister has been depressed.

FIG. 28*c* is a top view of the depressed blister of FIG. 28*b*.

FIG. 29*a* is a side view of an intact raised tab with a second embodiment of an injection molded design.

FIG. 29*b* is a side view of the dimpled blister of FIG. 29*a* wherein the blister has been depressed.

FIG. 29*c* is a top view of the depressed blister of FIG. 29*b*.

FIG. 30*a* is a side view of an intact raised tab with a third embodiment of an injection molded design.

FIG. 30*b* is a side view of the raised tab of FIG. 30*a* wherein the blister has been depressed.

FIG. 30*c* is a top view of the depressed blister of FIG. 30*b*.

FIG. 31 shows a side view of the raised tab of FIG. 30*a* wherein one side of the blister has accidentally collapsed.

FIG. 32 is a side view of an intact raised tab with a fourth embodiment of an injection molded design.

FIG. 33 is a side view of the raised tab of FIG. 32 wherein the blister has been depressed.

FIG. 34 is a side view of the intact raised tab of FIG. 32 wherein a pill is contained within.

FIG. 35 is a side view of the blister of FIG. 34 wherein the blister is depressed and the pill has been pushed through.

DESCRIPTION OF THE PREFERRED EMBODIMENTS OF THE INVENTION

Figure 1:
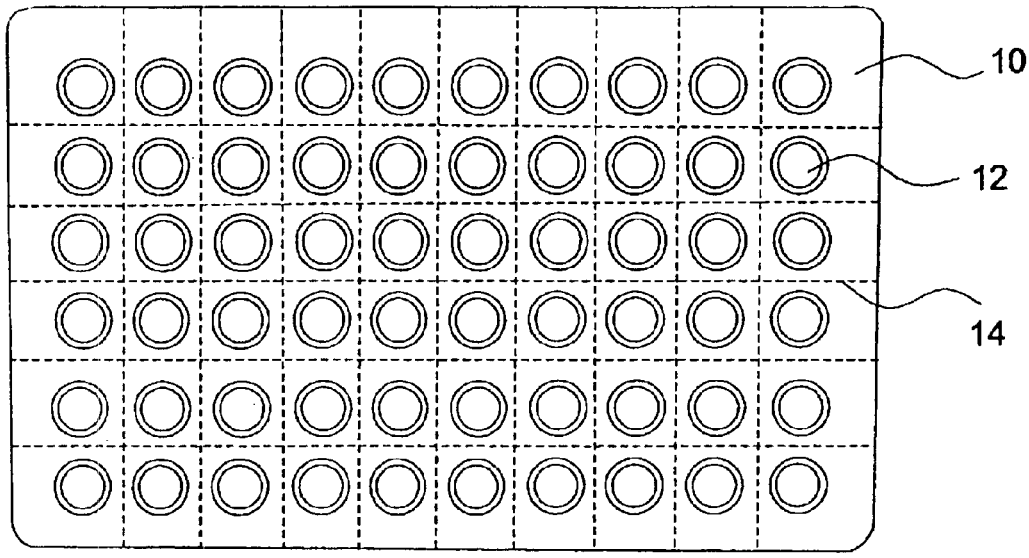
FIG. 1 is a plan view of the device containing multiple raised tabs configured into a pill card design.

The medication management system of the present invention is preferably applied by the pharmacist to the medication container, or provided by the pharmacist, or at the pharmacy to the user, for application to the container. However, it can be applied by the manufacturer to the medication container, or provided by the manufacturer to the user, for application by the user. The system is readily employed by a pharmacy in combination with the pharmacy's computerized label printing system. The system is readily adaptable for institutional use, for example in nursing homes, hospitals, doctor's offices, veterinarian offices and the like. The device can have written guides on it to identify day of the week and dosage required or it can be of a plain design. Furthermore, these written guides can be in the form of Braille or raised letters for the visually impaired. The device provides an advantage over existing systems for tracking and/or dispensing medication in that both visual and tactile signals are provided for the user.

Individuals can readily apply the device to their own medication containers. The device can be an overlay that is applied to a medicine container. In those instances where the bottle, or other form of container, is too small to separately accommodate both the pharmacy label, with its required information, and the medication regimen management label, the device is most advantageously easily removable, as for example, through the use of a releasable adhesive, as well known in the art. Alternatively, the device can be incorporated into blister packs to dispense the medication.

Preferably, the overlay type of device is transparent, enabling a user to readily see information such as prescription name, name of the pharmacy, and the like. In a preferred embodiment, the pharmacy label is coordinated with the management system label, and attached by the pharmacist in combination with the prescription label.

In another preferred embodiment the medication regimen label is attached to the container at only one edge of the label. This one edge attachment leaves the prescription label of the bottle totally accessible while still keeping the label to with the container. The edge having adhesive can be attached to any area of the container, but preferably is attached to a part of the container that does not obstruct the viewing of the prescription label. The remainder of the medication regimen label hangs freely. With this attachment configuration, the label can also serve as a flag that draws attention to the package, thereby decreasing the likelihood that the user will forget to take the medication. The label is preferably a bright, eye-catching color.

The label adhesive should provide the required level of adhesion, either permanent or releasable, at the temperature typically found in refrigerators, since it is common to store medications at reduced temperature, or in cool environments.

The information on the device preferably includes such information as medicine dosage options, time of the day for taking the medication, days of the week, and other desired information. The medicine dosage options can be, for example, daily, multiple times per day, as required, maximum usage, or occasional usage. Preprinted devices can be designed to start with any day of the week. This would serve to avoid the problem of the user inadvertently marking the label at the first day on the label, rather than with the first actual day of usage.

The labels can be pre-printed in sets for sale in a retail establishment, such as a pharmacy. Alternatively, the pharmacist can provide the labels at the time of sale of a prescription medication.

The releasable adhesive provides the most convenient and economical mechanism for enabling the user to peel off the label. Alternatively, a hook and loop system can be used. The hook and loop system is commonly available under the trademark VELCRO. In the case of a hook and loop system, either the hook element or the loop element can be on the container, and the other element is affixed to the label.

Figure 2:
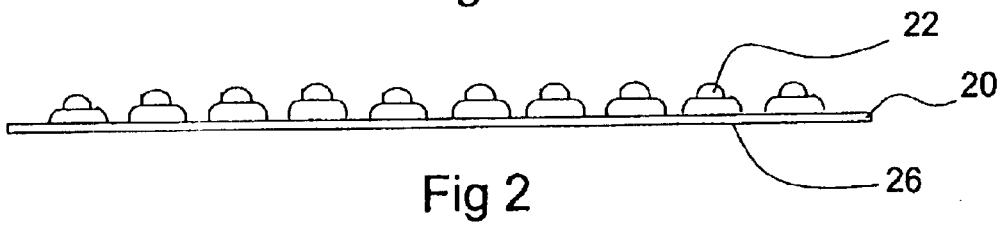
FIG. 2 is a side view of the device in FIG. 1.

Looking now to the Figures, FIG. 1 illustrates the basic design of the medication record system, in this case, a card 10 containing several rows of raised tabs 12. The card 10 can be manufactured from a variety of substances including flexible, transparent plastic and preferably contains an adhesive (not shown) covering at least a portion of the back of the card, allowing it to be positioned and affixed to a desired substrate. The card 10 can also have score lines or perforations 14 between each raised tab 12, enabling the user to remove one or more rows of raised tabs or individual raised tabs in order to customize their medication management. The perforations enable the user or provider of the labels to customize the label to correspond to the number of doses per day and the number of days for the medication period. Preferably, however, the manufacturer can make medication regimen labels corresponding to different required doses. Thus, 3 doses a day for 8 days would correspond to three rows by eight rows of tabs. FIG. 2 shows a side view of the management card shown in FIG. 1. The card 20 and raised tabs 22 are shown in profile and the adhesive backing 26 is now visible.

Figure 3A:
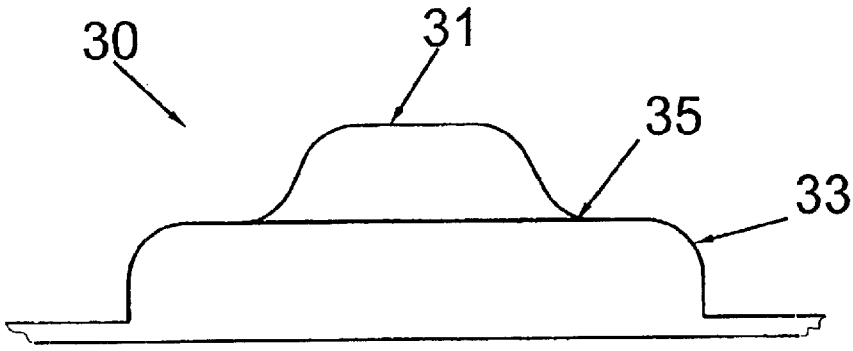
FIG. 3A is a close up side view of one embodiment of an intact raised tab of the device.

FIG. 3A shows a side view of a preferred raised tab embodiment having a raised surface 33 and a blister 31 centered on raised surface 33. A collapsible area 35 surrounds blister 31 and allows the raised tab to collapse uniformly when depressed by a user. FIG. 3A shows the raised tab in its non-depressed configuration while FIG. 4 illustrates the collapsed tab 40. When the tab is collapsed, the tab changes color. The change in color is preferably due to the transparent tab 30 becoming opaque when the tab is depressed. When in the depressed configuration, the tab is both visibly and tactilely different from the non-depressed configuration, thus serving as a double cue that a dosage has been taken and duly recorded.

Figure 3B:
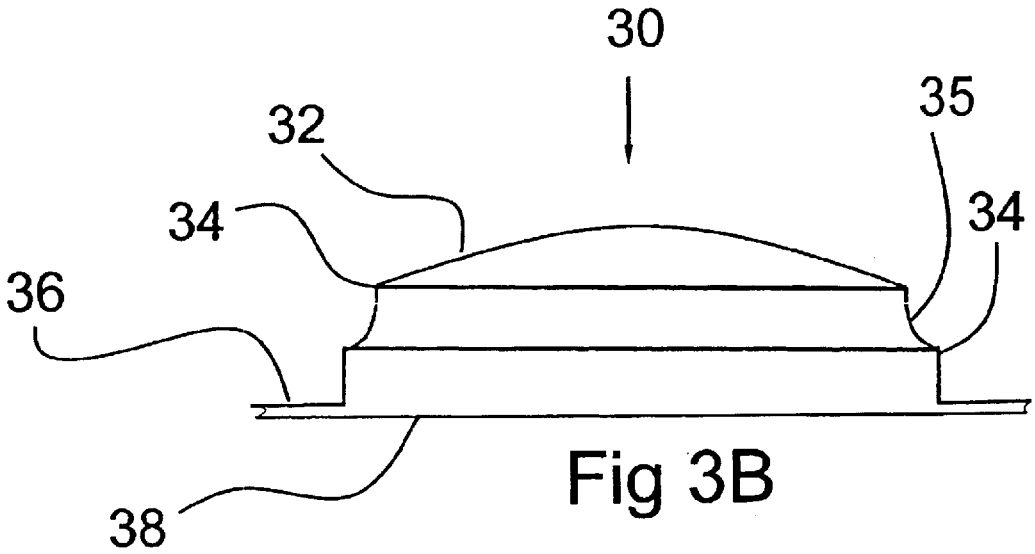
FIG. 3B is a close up side view of one embodiment of an intact dimpled blister of the device.

FIG. 3B shows a side view of an embodiment having a single dimpled blister prior to a user pressing it to record the use of medication. The clear blister 30 contains a rounded top surface 32 and two concentric depression rings 34 which form the dimple 35. The dimple 35 can be considered a collapsible area that enables the blister to collapse uniformly and be clearly distinguished from an inadvertent crushing of a blister due to, as for example, pressure at one edge of a blister. An adhesive layer 38 comprises the remainder of the device. The device could also contain a backing sheet 36, but this is not necessary in all embodiments. In FIG. 4, the dimpled blister 40 has been depressed so that the rounded surface and the concentric depression rings making up the dimple are no longer visible. The top surface 42 is now inverted and flattened leaving a tactilely different surface for the user to feel. Furthermore the once clear blister is now opaque providing a visual signal along with the tactile signal. The adhesive layer 46 and optional backing layer 44 remain unchanged from its original configuration.

FIG. 5 shows an alternate embodiment of the dimpled blister 50 wherein an additional concentric depression ring 58 is added to the existing pair of concentric depression rings 54 and 56 to make up the dimple. The rounded top surface 52 of the dimpled blister has not been depressed.

FIG. 5*a* shows a further alternate embodiment of the dimpled blister 50*a* wherein an additional concentric depression ring 58*a* is added to the existing pair of concentric depression rings 54*a* and 56*a* to make up the dimple. In this embodiment, the top surface 52*a* of the dimpled blister is flat and in combination with the circular depression rings provides for the blister, after depression to be demarked by collapsed rings and a clear, flat, central region. The distortion of the depression rings turns the plastic from clear to opaque, as well known in the art. FIG. 5*b* shows a top view of the collapsed dimpled blister in FIG. 5*a*. The concentric depression rings 54*a*, 56*a*, 58*a* have been depressed and the top surface 52*a* is flattened. The area-between the rings designated 55, 57 has changed from a transparent appearance to an opaque one, providing the user with a visual signal that the medication has been taken for that time period.

FIG. 6 illustrates a bottle system, or other form of medicine container, indicated generally as 60, with a medication management label 62 wrapped around the container 64. For simplicity, the raised tabs are not shown in this figure. It should be noted that the term "medicine", as used herein is intended to be a generic term inclusive of prescription and non-prescription medications, and additionally, inclusive of herbal remedies, vitamins and other medications. The system of the present invention should be understood as being useful when used with a regimen of any medicine or agent that maintains health or promotes recovery from injury or ailment.

FIG. 7 shows the medication management overlay 70 being separated from the underlying prescription label 72. To enable the separation of the medication label overlay 70 from the underlying prescription label 72, preferably, the overlay 70 is secured to the prescription label 72 by a pressure sensitive, releasable adhesive, as is well known in the adhesive art. Alternatively, the overlay can be releasable secured to the container 74 by a well-known hook and loop system, preferably applied at two opposite peripheral edges of the overlay.

FIG. 7B shows the preferred medication management label 71 having one end 71*a* attached to prescription label 73 of container 75. The label 71 could also be attached directly to container 75. Label 71 is preferably attached by an adhesive, which can be pressure sensitive and releasable. Alternatively, label 71 can be attached using a hook and loop system. In this attachment configuration the remainder of label 71 containing raised tabs 77 hangs freely from the container. As noted above, this free-hanging configuration serves as a flag drawing the attention of the patient to the package, thereby helping to remind the patient to take the medication. The flag labels are preferably manufactured in bright, eye-catching colors. These high visual-impact colors are well known in the art.

FIG. 8 shows a medication management label and prescription label combination 80, which contains typical prescription medication data. For example, patient name and address, pharmacy name and address, prescription number, dosage regimen, number of refills remaining, and refill expiration date can be printed on the label system 80. The management system data can be noted in the label region identified as 82. In the label system of FIG. 9, the medication management data is shown at an alternate position 92 on the label 90.

FIG. 10 shows a label overlay 100 which is illustrated as providing number of doses per day and the days of the week, for a two week or less prescription. The example of FIG. 10 shows a Monday through Sunday sequence and designates the doses, as one, two and three.

Figure 12:
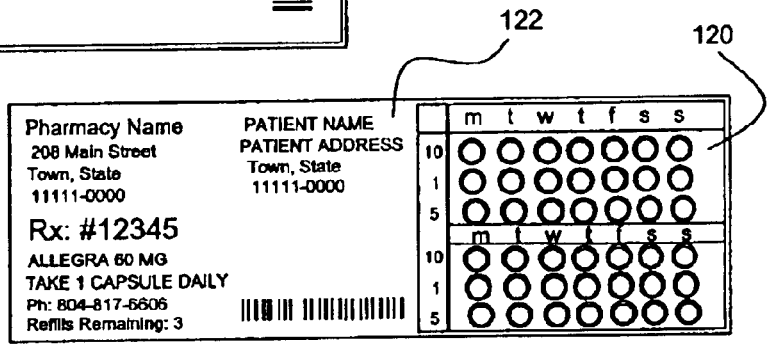
FIG. 12 is a plan view of an alternate embodiment of the medication management label overlay in combination with a prescription label.
Figure 13:
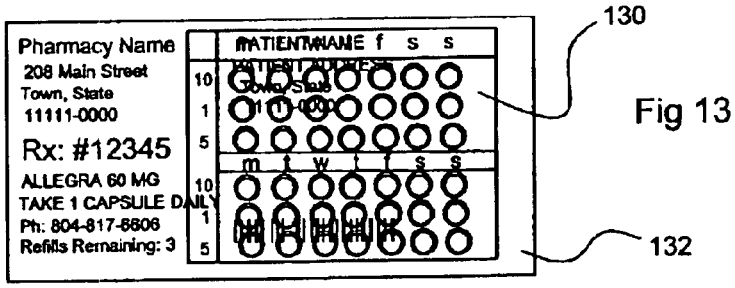
FIG. 13 is a plan view of an alternate embodiment of a prescription label in combination with a transparent medication management label overlay positioned on, and partly covering the writing on an underlying label.

FIG. 12 shows the label overlay 120, which is similar to that of label overlay 100 of FIG. 10, applied over a prescription label 122. In this case the label overlay 120 uses a time of day indicator for a three a day, two-week regimen of medication. The use of a transparent film is preferred so as to make it possible to read prescription information through the overlay. Alternatively, or in addition thereto, the use of a releasable adhesive enables one to have full access to the prescription data. It should be evident from FIG. 13, that the overlay 130 can be transparent or translucent, and can cover all or part of the underlying label 132. The use of a semi-opaque or translucent film provides the advantage of rendering the markings on the regimen label 132 more readily readable. Advantageously, the pressure-sensitive releasable adhesive is used with transparent overlays, as well as with opaque overlays. The adhesive can enhance the visibility of the writing or marking on the overlay 130, while not totally concealing the information on the prescription label 132.

Figure 11:
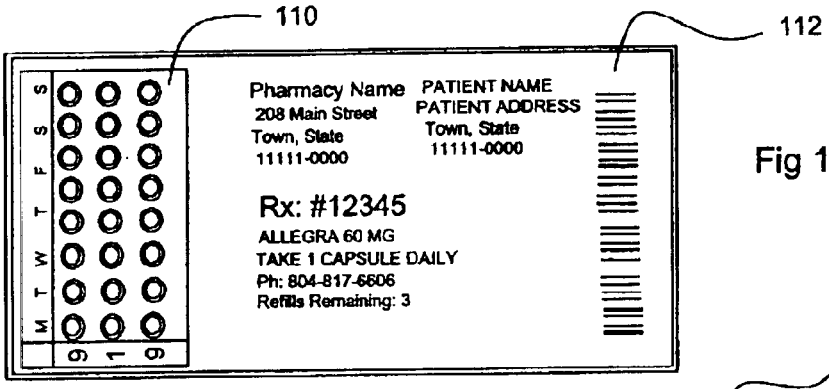
FIG. 11 is a plan view of an alternate embodiment of the medication management label overlay in combination with a prescription label.

FIG. 11 illustrates a system similar to that of FIG. 12, except that the overlay 110 is applied to the extreme left hand end of the prescription label 112, and is vertically oriented. It should be noted that the time of day notations on the overlays of FIGS. 11 and 12, for example, could be applied by hand, or preferably, automatically by the pharmacy compiler. The printing of the overlay information can be coordinated with the entry of prescription information, and thus a single entry of information would provide the data for the pharmacy data bank, the pharmacy's label and the overlay. Alternatively, the dosage can be indicated as being dose one, two and three, as illustrated in FIG. 10. Obviously, this would be coordinated with the actual number of doses per day, which is dictated by the dosage regimen.

Figure 14:
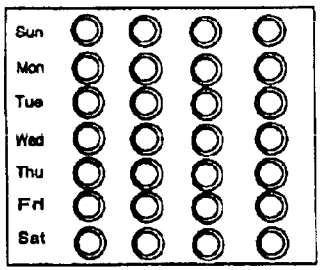
FIG. 14 is a plan view of a four dose per day medication management label overlay.

FIGS. 14 through 21 show alternate embodiments of overlay label patterns. FIG. 14 shows a one-week, four-dose label. The label can also be used to record compliance by the user under a four-week, single daily dose regimen.

Figure 15:
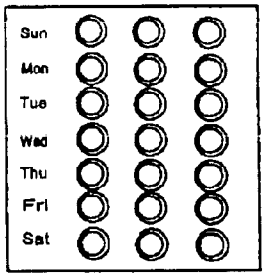
FIG. 15 is a plan view of a three dose per day medication management label overlay.
Figure 16:
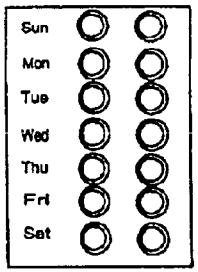
FIG. 16 is a plan view of a two dose per day medication management label overlay.
Figure 17:
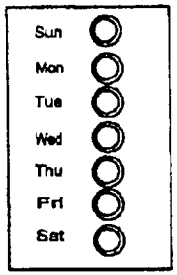
FIG. 17 is a plan view of a one dose per day medication management label overlay.

FIGS. 15, 16 and 17 show three, two, and single dose regimen patterns, and similarly, can be used with single dose, multiple week regimen recordation.

Figure 18:
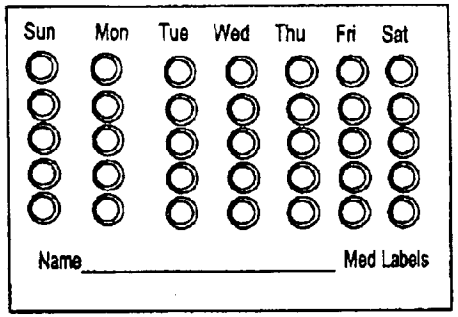
FIG. 18 is a plan view of a one-month, single dose per day medication management label overlay.
Figure 19:
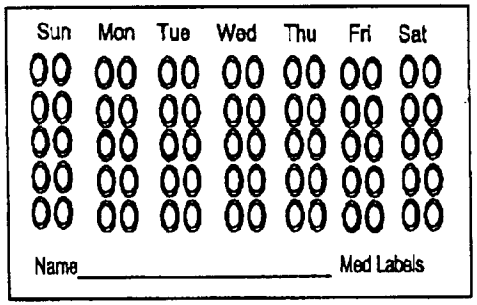
FIG. 19 is a plan view of a one-month, two dose per day medication management label overlay.

FIG. 18 shows a label having a pattern, which is conveniently used to record compliance with a single dose, one-month regimen. FIG. 19 shows a label having a pattern, which is conveniently used to record compliance with a two dose, one-month regimen.

Figure 20:
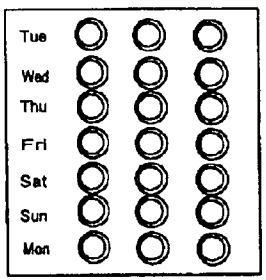
FIG. 20 is a plan view of a three dose per day or three week single dose overlay, showing a Tuesday through Monday week.
Figure 21:
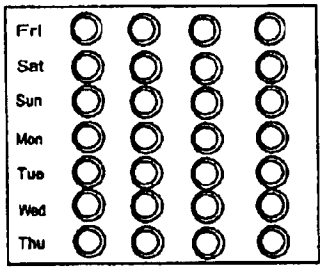
FIG. 21 is a plan view of a four dose per day or four week single dose overlay, showing a Friday through Thursday week.

FIGS. 20 and 21 show labels with three and four dose recordation patterns respectively. Alternatively, the pattern can be used for three week and four week, single dose regimens. That is, the columns of raised tabs can represent a series of weeks or doses per day.

FIGS. 14, 15, 16 and 17 are further noted to show a Sunday through Saturday sequence and respectively show four, three, two and a single column of raised tabs corresponding to medications requiring, 4, 3, 2 or 1 dose per day, respectively. By way of contrast, FIGS. 20 and 21 show label patterns in which the daily sequence starts with a Tuesday and a Friday respectively.

Figure 22:
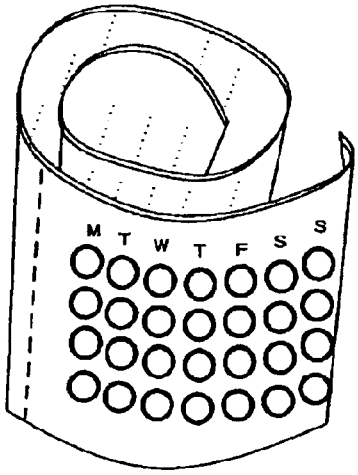
FIG. 22 is another alternative embodiment in which the overlay label is in the form of a roll of labels on a releasable substrate.

FIG. 22 shows a modification of the label, in which the label is manufactured in a roll allowing the user to remove one label overlay at a time from a larger stock. This reduces the packaging required for multiple label overlays of the same configuration.

Figure 23:
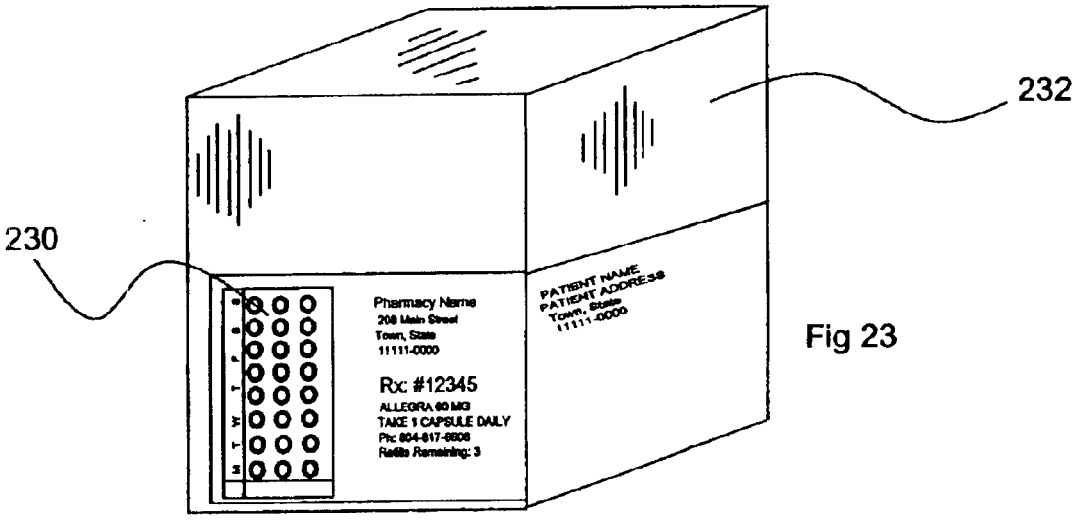
FIG. 23 shows an alternate embodiment in which the overlay is applied to a box.

FIG. 23 shows a label 230, corresponding in design to the label 110 of FIG. 11. The label 230 is shown applied to a rectangular container 232. The container can directly house the medicament, or can be a shipping container for a medicament container.

Figure 24:
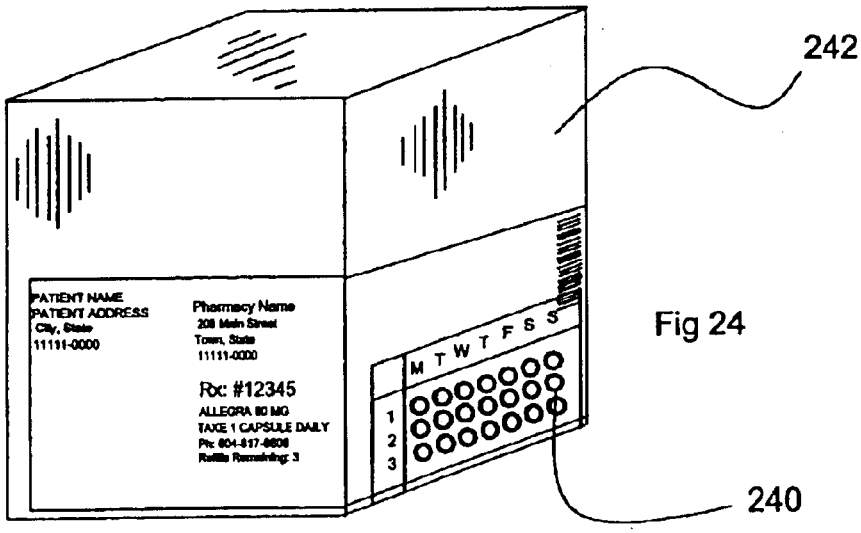
FIG. 24 shows an alternate embodiment in which the overlay is applied over an underlying label that is affixed to a box.

FIG. 24 shows a regimen label 240 applied to a rectangular container 242. The container 242 can directly house the medicament, or can be a shipping container for a medicament container.

Figure 25:
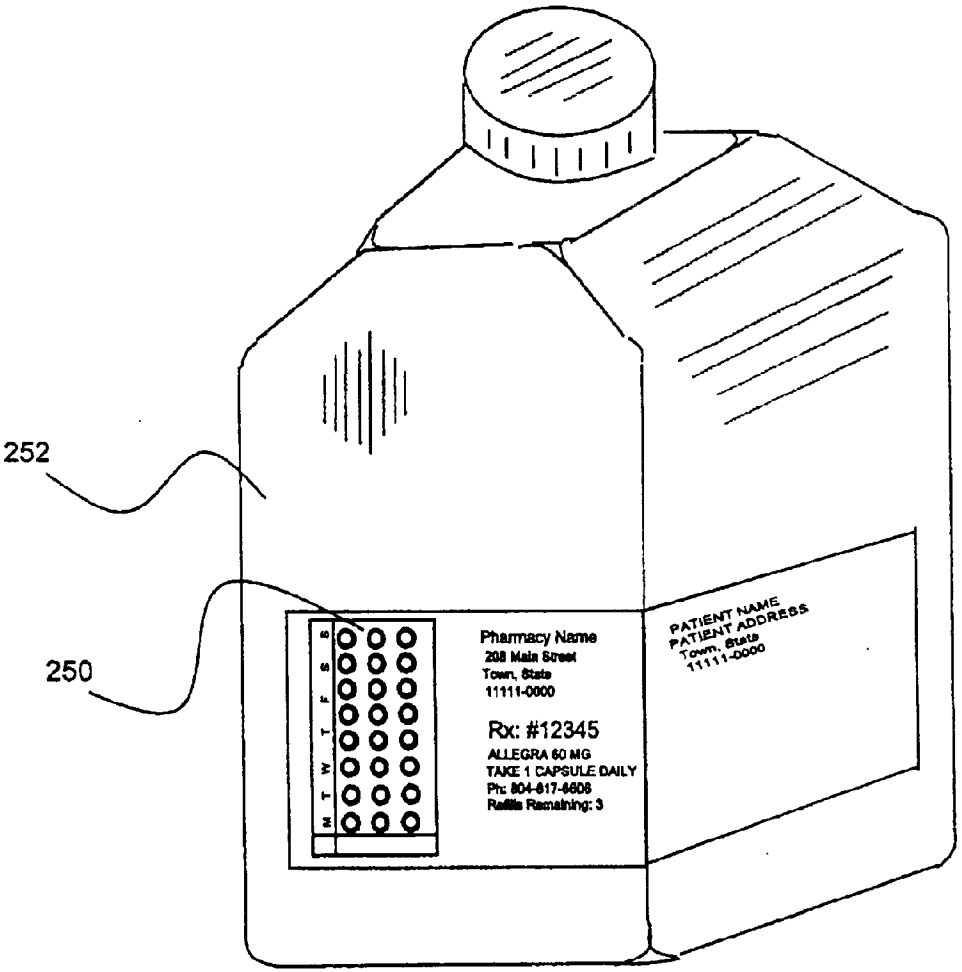
FIG. 25 shows an alternate embodiment in which the overlay is applied to a bottle, which can contain a liquid or pills.

FIG. 25 shows a label 250, corresponding in design to the label 110 of FIG. 11. The label 250 is shown applied to a rectangular bottle 252, of the type that is used with liquids, or alternatively, of the type which can be used with pills, caplets, capsules, and the like.

The combined prescription label/overlay medication regimen label can be printed at the pharmacy and thus customized to the particular requirements of a patient. The week can be started with any day of the week, depending on the day in which the prescription is being dispensed.

Figure 26:
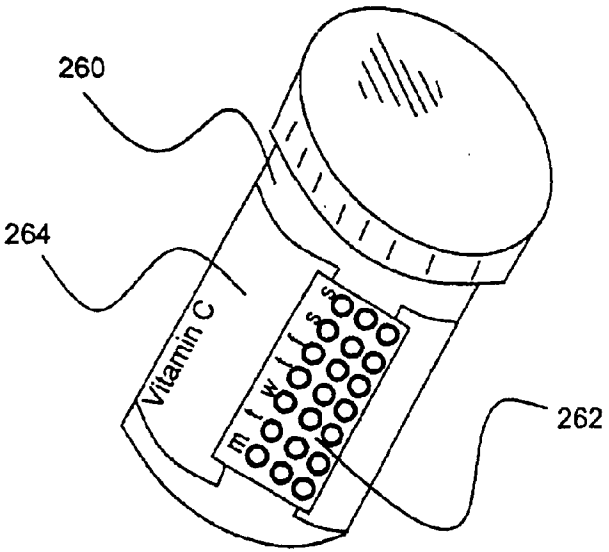
FIG. 26 is a further embodiment of the invention in which the overlay label is positioned on the container in a region that is substantially uncovered by the prescription label.

FIG. 26 shows a variation of the containers of FIGS. 6 and 7, in which the overlay label 262 is dimensioned such that it can be applied to a region of the container 260, which is not covered by a prescription or similar label 264. It is noted that while reference is made to prescription labels, and the system of the present invention is uniquely suited for use with such labels, the system of the present invention is also applicable to non-prescription labels. As shown in FIG. 26, the overlay label 262 is positioned essentially between the two ends of the underlying prescription label 264. In this manner, the overlay label 262 does not cover information displayed on the underlying label 264. An opaque or semi-opaque label can be used in this instance, since it is not necessary to see through the overlay label 262.

Figure 27:
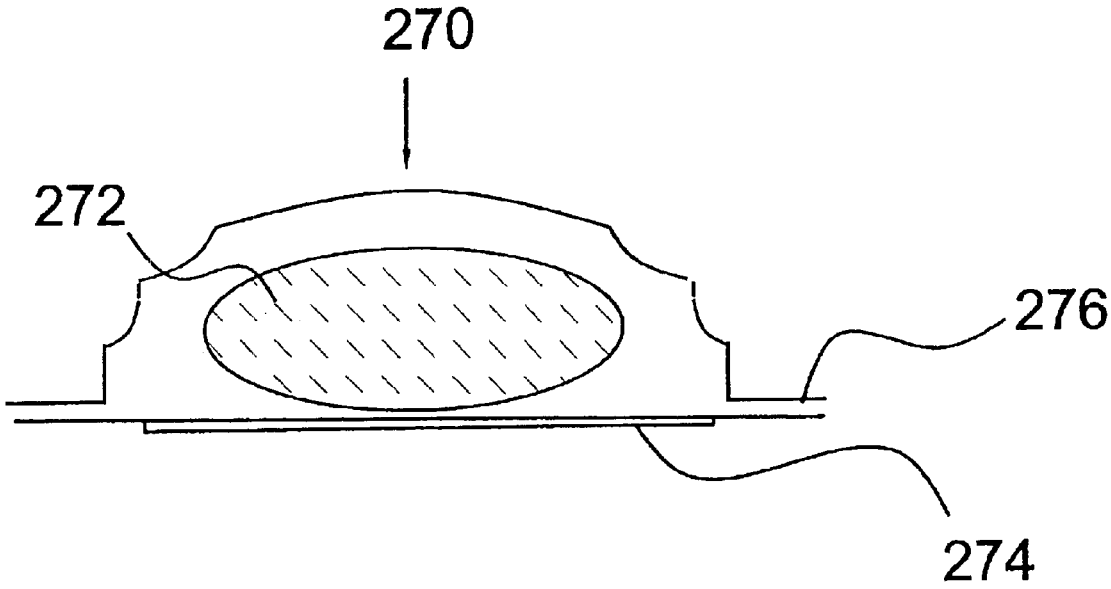
FIG. 27 is a side view of the dimpled blister serving as a medication dispenser and containing a pill or tablet.

In FIG. 27 the use of the dimpled blister in a blister card as a means for dispensing medication, vitamins or other supplements in pill or tablet form is shown in a cutaway side view. The dimpled blister 270 surrounds the pill or tablet 272 and an underlying backing 274 is placed such that the pill 272 can be pushed through the blister card 276 with a minimal force. Various types of backings 274 to achieve this desired function are well known in the art. The dimpled blister 270 then flattens as described herein and changes from transparent to opaque providing the tactile and visual signals that are useful for maintaining the medication regimen. It should be noted that presence or absence of the pill 272 provides one level of visual signaling that medication has been taken but that the transparent to opaque change in the dimpled blister provides an additional level of visual signal.

FIGS. 28 through 30 demonstrate a variety of the different styles of dimpled blisters that can be created by using an injection mold, vacuum forming or the like. The specific method of manufacture is not narrowly critical. Typically, with thin sheet materials, vacuum forming is a convenient manufacturing technique. FIG. 28*a* shows one embodiment of an injection-molded design for the dimpled blister 280. Two small rings of plastic 282, 284 that are thinner than the remaining plastic in the blister 280 provide the mechanism for collapse. Once the blister is depressed, the rings of plastic 282, 284 collapse in the manner shown in FIG. 28*b*, providing a more uniform collapse. This design reduces the likelihood of an uneven shape that could be misread tactilely by the user. FIG. 28*c* shows a top view of the collapsed blister described in FIG. 28*b*.

FIG. 29*a* shows a second embodiment of an injection-molded design for the dimpled blister. In this embodiment, two larger rings of plastic 292, 294 form an internal cut-out that is thinner than the remaining plastic in the blister and provide the mechanism for collapse. Once the blister is depressed, the rings of plastic 292, 294 collapse in the manner shown in FIG. 29*b*, providing a more uniform collapse. This design again reduces the likelihood of an uneven shape forming after the blister is depressed that could be misread tactilely by the user. FIG. 29*c* shows a top view of the collapsed blister described in FIG. 29*b*.

FIG. 30*a* shows a third embodiment of an injection-molded design for the dimpled blister 300. In this embodiment, two larger rings of plastic 302, 304 form an external cut-out that is thinner than the remaining plastic in the blister and provide the mechanism for collapse. Once the blister is depressed, the rings of plastic 302, 304 collapse in a controlled manner as shown in FIG. 30*b*. This design again reduces the likelihood of an uneven shape forming after the blister is depressed that could be misread tactilely by the user. FIG. 30*c* shows a top view of the collapsed blister described in FIG. 30*b*.

FIG. 31 shows a non-uniformly collapsed blister 310 of the style shown in FIG. 30. When a package contained the blister cards is inadvertently damaged or pressure is accidentally applied to the blister on a side, the blister will collapse in the fashions shown, providing a different visual and tactile cue for the user. The user will then be able to distinguish a properly collapsed blister from one that is inadvertently damaged. This adds a layer of confidence to the medication tracking system so that the user can be assured of a proper medication regimen.

FIG. 32 shows a fourth embodiment of an injection-molded design for the dimpled blister 320. In this embodiment, two larger rings of plastic 322, 324 form an internal cut-out that is thinner than the remaining plastic in the blister and that is separated from the top of the blister. These rings provide the mechanism for collapse. Once the blister is depressed, the rings of plastic 322, 324 collapse in a controlled manner as shown in FIG. 33. As in the previous embodiments, this design reduces the likelihood of an uneven shape forming after the blister is depressed that could be misread tactilely by the user.

FIG. 34 shows the blister of FIG. 32 as used in combination to hold medication and as a medication tracker. The blister card 340 contains the medication 342 between the blister 344 and the backing card 346 or materials well known in the art. When the blister 344 is depressed, the medication 342 pushes through the backing card 346, tearing open the backing card 346 and releasing the medication 342 as shown in FIG. 35. In FIG. 35, the medication 352 has been pushed through the blister card 350 by depressing the blister 354. The backing 356 has tears upon depression of the blister 354 to permit the medication 352 to pass through. The blister 354 flattens out and changes from transparent to opaque providing tactile and visual cues that the medication has been taken.

Figure 36:
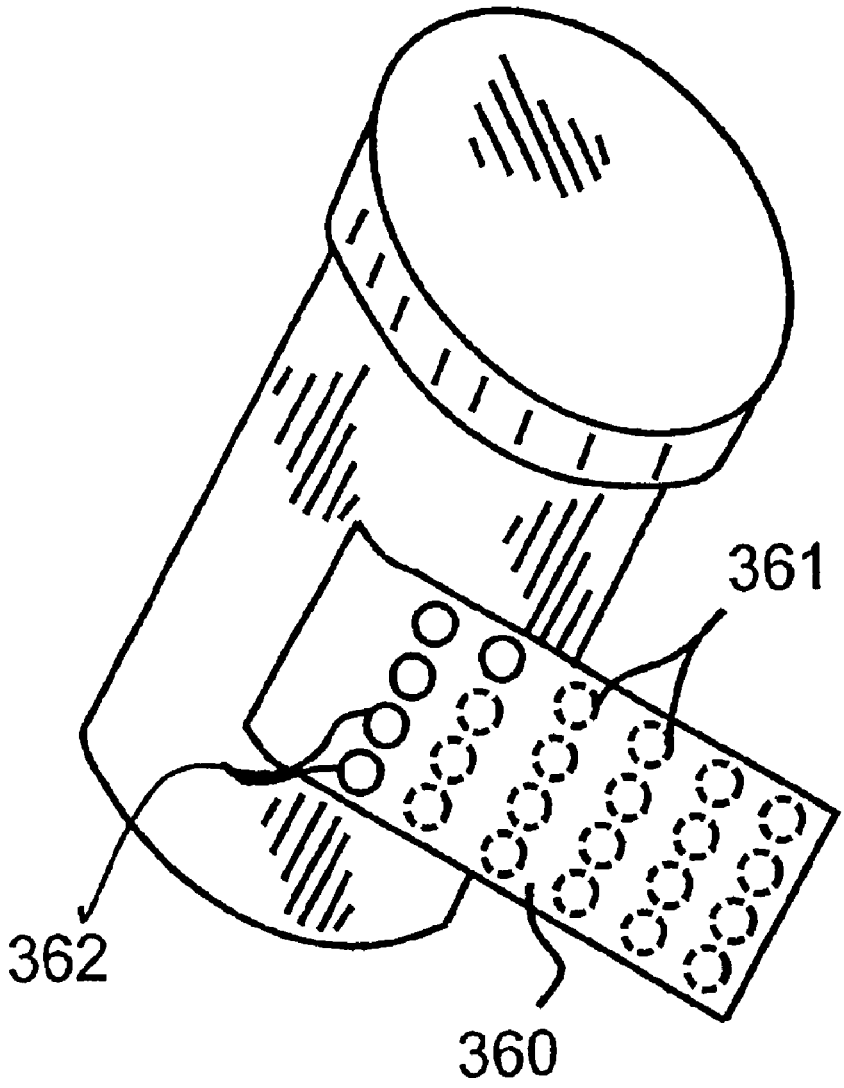
FIG. 36 is a perspective view of a medication container having a punch-out plug medication label attached at one edge of the label.

Another embodiment of a medication management device comprises a label with punch-out plugs, as shown in FIG. 36, instead of raised tabs. These punch-out plugs 361 are arranged in rows on label 360 just as the raised tabs described previously herein. Plugs 361 are simply perforated areas that can be easily removed from the label, thereby leaving holes 362 in the label where the plugs were once attached. Each plug 361 is removed by pushing on the plug using either one's finger or an item such as a pencil.

Figure 37:
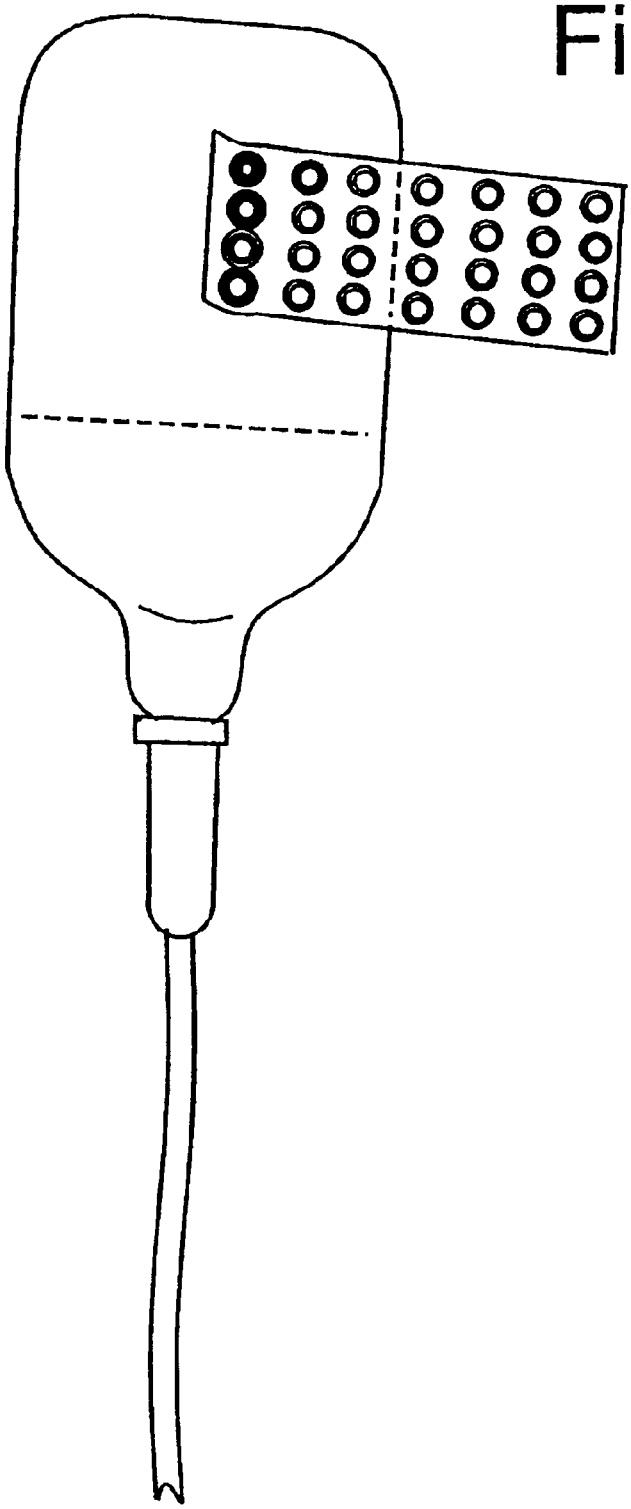
FIG. 37 is a perspective view of an I.V. reservoir having a medication management label attached.

Thus far, the invention has been shown and described as being used on medication bottles and pill packages. However, the label can be used on other items for monitoring dosages such as I.V. reservoirs shown in FIG. 37. The tabs on the label can be manufactured to correspond to I.V. dosage regimens. With this embodiment the label becomes a tool for health care providers to record treatments that is a double check of the information maintained in the patient's chart.

The preceding examples are provided for descriptive purposes solely and are not meant to limit the embodiments of the invention. Other configurations of the medication record and dispensing system will become apparent to those of ordinary skill in the art.

What is claimed is:

1. A medication management device comprising:

a medication regimen label, said medication regimen label having a dosage recording region arranged in rows;

wherein said medication regimen label displays in an in-line arrangement the days of the week;

wherein said dosage recording region of said medication regimen label is in parallel relationship to said in-line arrangement of days of the week and wherein said dosage recording region is a plurality of raised tabs, wherein a user depresses one of said raised tabs to indicate that a dosage of medicine has been taken, and wherein each of said raised tabs changes color when said tab is depressed; and wherein medication is located between each of said raised tabs and a backing layer.

2. A medication management device comprising:

a medication regimen label, said medication regimen label having a dosage recording region arranged in rows;

wherein said medication regimen label displays in an in-line arrangement the days of the week;

wherein said dosage recording region of said medication regimen label is in parallel relationship to said in-line arrangement of days of the week and wherein said dosage recording region is a plurality of raised tabs, wherein a user depresses one of said raised tabs to indicate that a dosage of medicine has been taken, and wherein each of said raised tabs changes color when said tab is depressed; and wherein said raised tabs and said medication regimen label are transparent.

3. The medication management device of claim 2, wherein when said raised tabs are in a depressed configuration said raised tabs are opaque.

4. The medication management device of claim 2, further comprising a backing sheet.

5. The medication management device of claim 2, further comprising a mechanism for releasably securing said medication regimen label to a medication container.

6. The medication management device of claim 2, wherein the number of raised tabs and the number of rows of raised tabs on a particular medication regimen label is determined by a dosage requirement of a particular patient.

7. The medication management device of claim 2, further comprising a mechanism for configuring said medication regimen label to correspond to a dosage requirement of a particular patient.

8. The medication management device of claim 2 wherein said raised tabs are arranged to correspond to the days of the week.

9. The medication management device of claim 5, wherein said medication container is a bottle.

10. The medication management device of claim 5, wherein said medication container is a box.

11. The medication management device of claim 5, wherein said medication container is an I.V. reservoir.

12. The medication management device of claim 5, wherein said mechanism for releaseably securing said medication regimen label is a releasable adhesive.

13. The medication management device of claim 5, wherein said mechanism for releaseably securing said medication regimen label is a hook and loop system.

14. The medication management device of claim 7, wherein said mechanism is a series of perforated lines separating each of said raised tabs on said medication regimen label.

15. A medication management device comprising:

a medication regimen label, said medication regimen label having a dosage recording region arranged in rows; and a mechanism for releasably securing said medication regimen label to a medication container;

wherein said medication regimen label displays in an in-line arrangement the days of the week; and wherein said dosage recording region of said medication regimen label is in parallel relationship to said in-line arrangement of days of the week and wherein said dosage recording region is a plurality of raised tabs, wherein a user depresses one of said raised tabs to indicate that a dosage of medicine has been taken, wherein each of said raised tabs changes color when said tab is depressed; and wherein said medication regimen label is transparent and overlays a prescription label of said medication container when said medication regimen label is secured to said medication container.

16. The medication management device of claim 15, wherein only one edge of said medication regimen label is attached to a portion of said medication container when said medication regimen label is secured to said medication container.

17. The medication management device of claim 15, wherein said medication regimen label is made of a material having a high visual-impact color.

18. A method of monitoring a regimen for taking a medication comprising, the steps of:

filling a medicine container with a predetermined quantity of a medication;

applying a preprinted medication label to a medication container, said medication label being substantially permanently adhered to said container;

applying a medication regimen label to said container, said medication regimen label having a plurality of raised tabs arranged in rows and a display indicating the days of the week, wherein said raised tabs are arranged to correspond in line to the days of the week; wherein each of said raised tabs comprise a raised surface having a blister in the center of said raised surface and a collapsible area where said blister meets said raised surface, and depressing one of said raised tabs of said medication regimen label when a dose is taken, wherein said depressed raised tab corresponds to the day and dose taken.

19. The method of claim 18, wherein said medication label and said medication regimen label are simultaneously applied to said medicine container, in the form of a combined label.

* * * * *